US009777359B2

(12) United States Patent
Liu et al.

(10) Patent No.: US 9,777,359 B2
(45) Date of Patent: Oct. 3, 2017

(54) BULK FERROMAGNETIC GLASSES FREE OF NON-FERROUS TRANSITION METALS

(71) Applicant: California Institute of Technology, Pasadena, CA (US)

(72) Inventors: Xiao Liu, Pasadena, CA (US); Marios D. Demetriou, West Hollywood, CA (US); William L. Johnson, San Marino, CA (US); Michael Floyd, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 505 days.

(21) Appl. No.: 14/272,136

(22) Filed: May 7, 2014

(65) Prior Publication Data

US 2014/0332120 A1 Nov. 13, 2014

Related U.S. Application Data

(60) Provisional application No. 61/820,327, filed on May 7, 2013.

(51) Int. Cl.

| | |
|---|---|
| ***C22C 45/02*** | (2006.01) |
| ***C21D 1/18*** | (2006.01) |
| ***C22C 33/00*** | (2006.01) |

(52) U.S. Cl.

CPC ..... *C22C 45/02* (2013.01); *C21D 1/18* (2013.01); *C22C 33/003* (2013.01)

(58) Field of Classification Search

None

See application file for complete search history.

(56) References Cited

U.S. PATENT DOCUMENTS 5,961,745 A * 10/1999 Inoue ..... H01F 1/15308 148/304
6,077,367 A * 6/2000 Mizushima ..... C22C 45/02 148/304
8,911,572 B2 * 12/2014 Kim ..... C22C 45/02 148/304
9,359,664 B2 * 6/2016 Demetriou ..... C22C 45/02

(Continued)

OTHER PUBLICATIONS

Elliott, "The story of magnetism", Physica A 384, May 2007, pp. 44-52.

(Continued)

*Primary Examiner* — Colleen Dunn
(74) *Attorney, Agent, or Firm* — KPPB LLP

(57) ABSTRACT

Ferrous metal alloys including Fe, Co and optionally Ni with metalloids Si, B and P are provided that are substantially close to the peak in glass forming ability and have a combination of both good glass formability and good ferromagnetic properties. In particular, Fe/Co-based compositions wherein the Co content is between 15 and 30 atomic percent and the metalloid content is between 22 and 24 atomic percent at a well-defined metalloid moiety, have been shown to be capable of forming bulk glassy rods with diameters as large as 4 mm or larger. In addition, incorporating a small content of Ni under 10 atomic percent and additions of Mo, Cr, Nb, Ge, or C at an incidental impurity level of up to 2 atomic percent are not expected to impair the bulk-glass-forming ability of the present alloys.

20 Claims, 8 Drawing Sheets

(56) References Cited

U.S. PATENT DOCUMENTS

| | | | | |
|---|---|---|---|---|
| 2006/0254386 | A1* | 11/2006 | Inoue | B22F 3/006 75/246 |
| 2010/0096045 | A1* | 4/2010 | Sato | C22C 38/02 148/304 |
| 2010/0300148 | A1* | 12/2010 | Demetriou | C22C 45/02 63/12 |
| 2012/0073710 | A1* | 3/2012 | Kim | C22C 45/02 148/548 |

OTHER PUBLICATIONS

Li et al., "The effect of Co addition on glassy forming ability and soft magnetic properties of Fe—Si—B—P bulk metallic glasses", Key Engineering Materials, Mar. 27, 2012, vol. 508, pp. 112-116.

* cited by examiner

BULK FERROMAGNETIC GLASSES FREE OF NON-FERROUS TRANSITION METALS

CROSS-REFERENCE TO RELATED APPLICATIONS

The present application claims priority to U.S. Provisional Patent Application No. 61/820,327, entitled "Bulk Ferromagnetic Glasses Free Of Non-Ferrous Transition Metals", filed on May 7, 2013, which is incorporated herein by reference in its entirety.

TECHNICAL FIELD

The present disclosure is directed to (Fe—Co—Ni)-(Si—B—P) glasses capable of forming bulk glassy rods with diameters greater than 1 mm and as large as 4 mm or larger.

BACKGROUND

Ferromagnetic glasses based on ferrous metals (i.e. metals from the Iron Triad) Fe, Co, and Ni and bearing metalloids such as P, C, B, and Si have been known since the early 1970's. These early glasses exhibited soft ferromagnetic properties, and were only capable of forming glasses that were a few micrometers thick. Fe—Si—B and Fe—P—C are two example systems of such ferromagnetic glass formers. More recently, it was discovered that incorporating small fractions of non-ferrous transition metals in these early compositions leads to ferromagnetic glasses that can be formed in bulk dimensions, that is, formed into sections that are at least 1 mm thick. Examples include Fe—Ni—P—C—B with an addition of about 5 atomic percent Mo, and Fe—Co Si—B or Fe—Ni—Si—B with an addition of about 5% Nb. All of these cases led to ferromagnetic bulk-glass formers capable of forming glassy rods greater than 1 mm in diameter.

In these systems, while small additions of non-ferrous transition metals such as Mo and Nb have been shown to dramatically enhance the glass-forming ability of these early marginal glass formers, they also degrade the ferromagnetic performance of these alloys, as they lead to lower saturation magnetization and higher coercivity and remanence. It would therefore be of interest to discover ferromagnetic bulk-glass formers that are free of non-ferrous transition metals such that they combine the superb ferromagnetic performance of the early glassy ferromagnets with the capability to form bulk glassy components.

Recently, Li et al. (X. Li, Y. Zhang, H. Kato, A. Makino, and A. Inoue, "The Effect of Co Addition on Glassy Forming Ability and Soft Magnetic Properties of Fe—Si—B—P Metallic Glass", Key Engineering Materials 508, 112-116 (2012), the reference of which is incorporated herein in its entirety) have investigated the Fe—Co—Si—B—P system. They replaced Fe with Co in a unique metalloid moiety with the atomic concentrations of Si, B, and P fixed at 9, 10, and 5 percent, respectively. By means of an ultra-high quench rate processing method (copper mold casting), they determined the largest critical rod diameter associated with that metalloid moiety to be 3 mm.

BRIEF SUMMARY

The present disclosure provides embodiments directed to a metallic glass comprising an alloy represented by the following formula (subscripts denote atomic percent):

$$Fe_{(100-a-b-c-d-e)}Co_aNi_bSi_cB_dP_e$$

where a is between 2 and 60, b is up to 10, c ranges from 4 to less than 9, d ranges from 3 to less than 10, and e ranges from more than 5 to 15; and wherein the critical rod diameter is at least 1 mm.

In some embodiments, a is between 5 and 40, b is 0, c is between 5 and 8.5, d is between 4 and 9, e is between 6 and 13, and wherein the critical rod diameter is at least 2 mm.

In other embodiments, a is between 10 and 30, b is 0, c is between 6 and 8.5, d is between 5 and 8, e is between 7 and 12, and wherein the critical rod diameter is at least 2.5 mm.

In other embodiments, a is between 12 and 25, b is 0, c is between 6.5 and 8, d is between 5.5 and 7.5, e is between 8 and 11, and wherein the critical rod diameter is at least 3 mm.

In still other embodiments, a is between 2 and 60, b is less than 10, the sum of c, d, and e is between 21 and 25, and wherein the critical rod diameter is at least 1 mm.

In yet other embodiments, a is between 5 and 40, b is 0, the sum of c, d, and e is between 22 and 24, and wherein the critical rod diameter is at least 2 mm.

In still yet other embodiments, a is between 10 and 30, b is 0, the sum of c, d, and e is between 22.5 and 23.5, and wherein the critical rod diameter is at least 2.5 mm.

In still yet other embodiments, the ratio of the atomic fraction of Co to the atomic fraction Fe is between 0.2 and 0.4.

In still yet other embodiments, the solidus and liquidus temperatures of the alloy are within 100° C. apart when evaluated by a calorimetry scan rate of 20 K/min, and wherein the critical rod diameter is at least 1 mm.

In still yet other embodiments, the solidus and liquidus temperatures of the alloy are within 80° C. apart when evaluated by a calorimetry scan rate of 20 K/min, and wherein the critical rod diameter is at least 2 mm.

In still yet other embodiments, the solidus and liquidus temperatures of the alloy are within 60° C. apart when evaluated by a calorimetry scan rate of 20 K/min, and wherein the critical rod diameter is at least 2.5 mm.

In still yet other embodiments, the solidus and liquidus temperatures of the alloy are within 50° C. apart when evaluated by a calorimetry scan rate of 20 K/min, and wherein the critical rod diameter is at least 3 mm.

In still yet other embodiments, up to 2 atomic percent of Mo, Cr, Nb, Ge, or C can be incorporated in the composition.

In still yet other embodiments, the melt is fluxed with a reducing agent prior to rapid quenching.

In still yet other embodiments, the reducing agent is boron oxide.

In still yet other embodiments, the temperature during fluxing is at least 200 degrees above the liquidus temperature of the alloy.

In still yet other embodiments, the fluxing temperature is at least 1300° C.

In still yet other embodiments, the duration of fluxing is at least 500 s.

In still yet other embodiments, the melt temperature prior to quenching to form the amorphous sample is at least 200 degrees above the liquidus temperature of the alloy.

In still yet other embodiments, the melt temperature prior to quenching to form the amorphous sample is at least 1300° C.

In still yet other embodiments, the metallic glass alloy composition is one of the following: $Fe_{60}Co_{17}Si_8B_7P_8$, $Fe_{60}Co_{17}Si_8B_{7.5}P_{7.5}$, $Fe_{60}Co_{17}Si_{8.5}B_7P_{7.5}$, $Fe_{60}Co_{17}Si_8B_6P_9$, $Fe_{60}Co_{17}Si_{7.5}B_{6.5}P_9$, $Fe_{60}Co_{17}Si_7B_7P_9$, $Fe_{60}Co_{17}Si_{6.5}B_{7.5}P_9$, $Fe_{60}Co_{17}Si_{8.5}B_{7.5}P_7$, $Fe_{60}Co_{17}Si_8B_7P_8$, $Fe_{60}Co_{17}Si_{7.5}B_{6.5}P_9$, $Fe_{60}Co_{17}Si_7B_6P_{10}$, $Fe_{55}Co_{22}Si_{8.5}B_{7.5}P_7$, $Fe_{50}Co_{27}Si_{8.5}B_{7.5}P_7$, $Fe_{60}Co_{17}Si_{6.5}B_{5.5}P_{11}$, $Fe_{60}Co_{17}Si_7B_6P_{10}$, $Fe_{60}Co_{17}Si_{7.5}B_{6.5}P_9$, $Fe_{60}Co_{17}Si_{6.5}B_{6.5}P_{10}$, $Fe_{60}Co_{17}Si_{7.5}B_{5.5}P_{10}$, $Fe_{60}Co_{17}Si_8B_5P_{10}$, $Fe_{60.4}Co_{17.1}Si_{7.3}B_{5.4}P_{9.8}$, $Fe_{59.6}Co_{16.9}Si_{7.7}B_{5.6}P_{10.2}$, $Fe_{55}Co_{22}Si_{8.5}B_{7.5}P_7$, $Fe_{50}Co_{27}Si_{8.5}B_{7.5}P_7$, and $Fe_{60}Co_{15}Ni_2Si_{7.5}B_{5.5}P_{10}$.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

DETAILED DESCRIPTION

Figure 1:
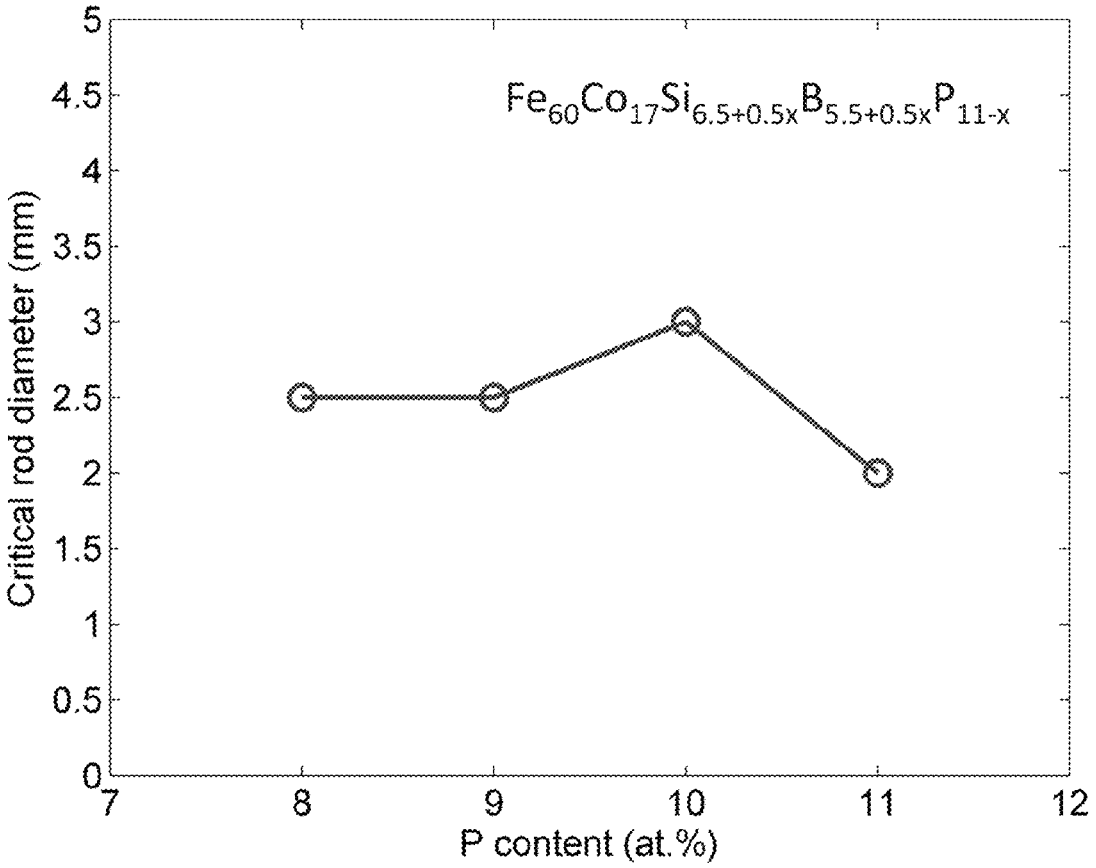
FIG. 1 provides a plot showing the effect of substituting P by equal amounts of Si and B according to the formula $Fe_{60}Co_{17}Si_{6.5+0.5x}B_{5.5+0.5x}P_{11-x}$ in accordance with embodiments of the invention.

The present disclosure may be understood by reference to the following detailed description, taken in conjunction with the drawings as described below. It is noted that, for purposes of illustrative clarity, certain elements in various drawings may not be drawn to scale.

DEFINITIONS

A "critical cooling rate", which is defined as the cooling rate required to avoid crystallization and form the amorphous phase of the alloy (i.e. the metallic glass), determines the critical rod diameter. The lower the critical cooling rate of an alloy, the larger its critical rod diameter. The critical cooling rate $R_c$ in K/s and critical rod diameter $d_c$ in mm are related via the following approximate empirical formula:

$$R_c=1000/d_c^2 \quad (1)$$

According to Eq. (1), the critical cooling rate for an alloy having a critical rod diameter of about 1 mm, as in the case of the alloys according to embodiments of the present disclosure, is only about $10^3$ K/s.

Generally, three categories are known in the art for identifying the ability of a metal alloy to form glass (i.e. to bypass the stable crystal phase and form an amorphous phase). Metal alloys having critical cooling rates in excess of $10^{12}$ K/s are typically referred to as non-glass formers, as it is physically impossible to achieve such cooling rates over a meaningful thickness. Metal alloys having critical cooling rates in the range of $10^5$ to $10^{12}$ K/s are typically referred to as marginal glass formers, as they are able to form glass over thicknesses ranging from 1 to 100 micrometers according to Eq. (2). Metal alloys having critical cooling rates on the order of $10^3$ or less, and as low as 1 or 0.1 K/s, are typically referred to as bulk glass formers, as they are able to form glass over thicknesses ranging from 1 millimeter to several centimeters. The glass-forming ability of a metallic alloy is, to a very large extent, dependent on the composition of the alloy. The compositional ranges for alloys capable of forming marginal glass formers are considerably broader than those for forming bulk glass formers.

In the present disclosure, the glass-forming ability of each alloy is quantified by the "critical rod diameter", defined as the largest rod diameter in which the amorphous phase can be formed when processed by a method of water quenching a quartz tube having 0.5 mm thick walls containing a molten alloy.

Quartz is known to be a poor heat conductor that retards heat transfer. Hence, the cooling rate attained when water quenching the melt in 0.5-mm-thick wall quartz tubes of a given inner diameter would be relatively low, and specifically considerably lower than the cooling rate attained by copper mold casting of the melt in a cavity of the same diameter. Thus, the "critical rod diameter" determined by the quartz water quenching method would not be comparable to the "critical rod diameter" determined by copper mold casting. Generally, the "critical rod diameter" determined by the quartz water quenching method would be lower than the "critical rod diameter" determined by copper mold casting.

Description of Alloy Compositions and Metallic Glass Compositions

In accordance with the provided disclosure and drawings, ferrous metal alloys including Fe, Co and optionally Ni with metalloids Si, B and P are provided that lie along a well-defined compositional ridge capable of forming metallic glasses with bulk dimensions. According to the Slater-Pauling curve (see for example R. Elliott, "The Story of Magnetism", Physica A 384, 44-52 (2007), the reference of which is incorporated herein in its entirety), which considers the atomic moment as a continuous function of the number of 3d and 4s valence electrons per atom across the first series of transition metals, an Fe—Co alloy at roughly 70/30 composition would be significantly more magnetic than either pure Fe or pure Co. In particular embodiments, Fe/Co-based compositions wherein the ratio of the atomic fraction of Co to the atomic fraction Fe is between 0.2 and 0.4 and the metalloid content is between 22 and 24 atomic percent, have been shown to be capable of forming bulk glassy rods with diameters as large as 4 mm or larger. In other embodiments, incorporating a small content of Ni ranging from the incidental impurity level of up to 2 atomic percent to 10 atomic percent, and additions of Mo, Cr, Nb, Ge, or C at an incidental impurity level of up to 2 atomic percent are not expected to impair the bulk-glass-forming ability of the present alloys. The present compositional ridge provides alloys that have a combination of both good glass formability and good ferromagnetic properties.

In the present disclosure it is recognized that the metalloid moiety of Fe—Co—Si—B—P alloys (which may optionally also include Ni), that is the relative concentrations of Si, B, and P, strongly influences the glass-forming ability and melting characteristics of the alloys. Hence, the metalloid moiety of the present alloys is carefully controlled such that the alloy compositions are substantially close to the peak in glass forming ability, and also substantially close to the quinary (or six-component) eutectic. This is because the embodiments of the composition associated with the peak in glass forming ability are thought to roughly coincide with the quinary (or six-component) eutectic composition. Therefore, the liquid crystallization and crystal melting behavior of the present alloys were investigated by differential scanning calorimetry and used as a guide to facilitate the formulation of the metalloid composition for glass forming ability by observing both liquid crystallization and crystal melting processes to determine those composition where the enthalpy change is sharpest (i.e., occurs over the shortest temperature range), which is indicative of a eutectic transition.

In some embodiments, ferromagnetic alloys that are substantially close to the peak in glass forming ability that have a critical rod diameter of at least 1 mm can be represented by the following formula (subscripts denote atomic percent):

$$Fe_{(100-a-b-c-d-e)}Co_aNi_bSi_cB_dP_e \quad (1)$$

where a ranges from 2 to 60, b ranges up to 10, c ranges from 4 to less than 9, and d ranges from 3 to less than 10, e ranges from more than 5 to 15. In some such embodiments the sum of c, d, and e is between 21 and 25.

$$Fe_{(100a-c-d-e)}Co_aSi_cB_dP_e \quad (2)$$

where a ranges from 5 to 40, c ranges from 5 to 8.5, and d ranges from 4 to 9, e ranges from 6 to 13. In some such embodiments the sum of c, d, and e is between 22 and 24.

In other embodiments, ferromagnetic alloys that are substantially close to the peak in glass forming ability that have a critical rod diameter of at least 2.5 mm can be represented by the following Equation (subscripts denote atomic percent):

$$Fe_{(100a-c-d-e)}Co_aSi_cB_dP_e \quad (2)$$

where a ranges from 10 to 30, c ranges from 6 to 8.5, and d ranges from 5 to 8, e ranges from 7 to 12. In some such embodiments the sum of c, d, and e is between 22.5 and 23.5.

In other embodiments, ferromagnetic alloys that are substantially close to the peak in glass forming ability that have a critical rod diameter of at least 3 mm can be represented by Equation (2) where a ranges from 12 to 25, c ranges from 6.5 to 8, and d ranges from 5.5 to 7.5, e ranges from 8 to 11. In some such embodiments the sum of c, d, and e is between 22.5 and 23.5.

Figure 2:
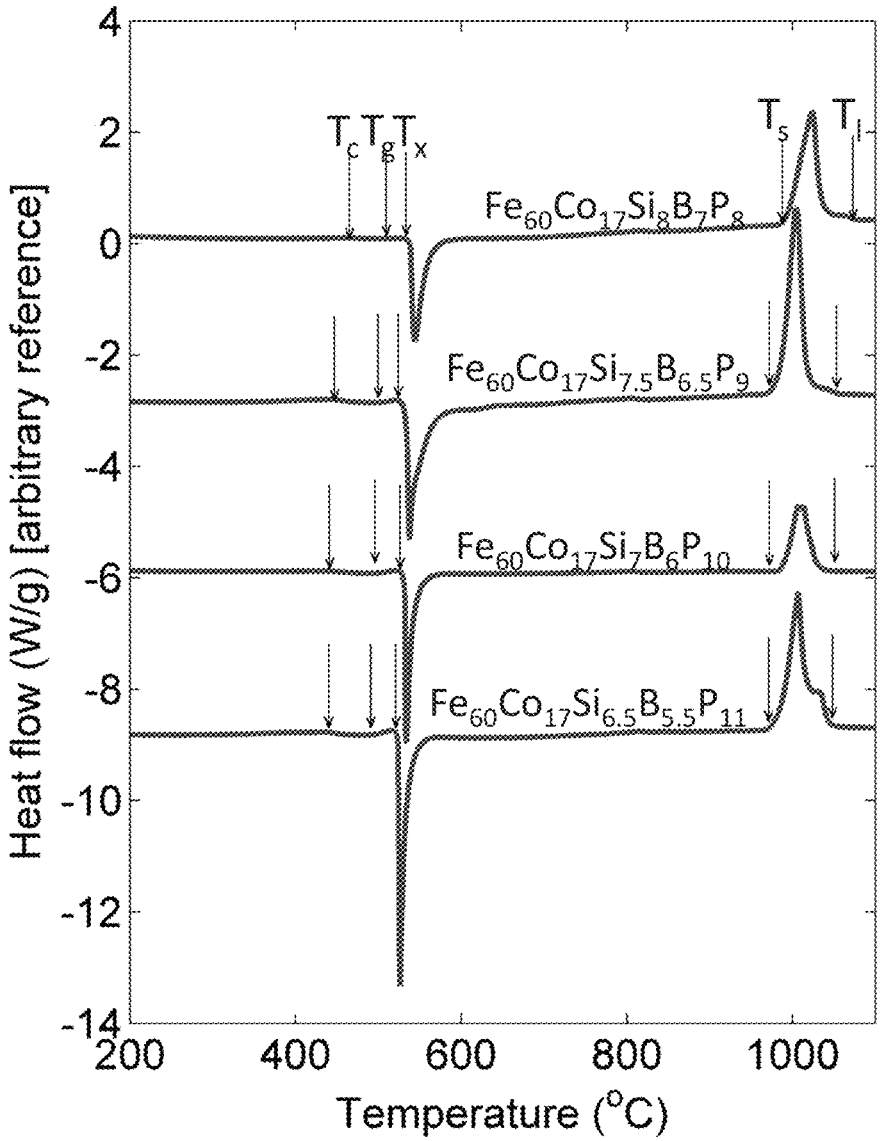
FIG. 2 provides a plot showing calorimetry scans for sample metallic glasses $Fe_{60}Co_{17}Si_{6.5+0.5x}B_{5.5+0.5x}P_{11-x}$ in accordance with embodiments of the invention. Arrows from left to right designate the Curie, glass-transition, crystallization, solidus, and liquidus temperatures, respectively.

Sample alloys (Examples 1-4) showing the effect of substituting P by equal amounts of Si and B according to the formula $Fe_{60}Co_{17}Si_{6.5+0.5x}B_{5.5+0.5x}P_{11-x}$, where x ranges between 0 and 3, are presented in Table 1 and FIG. 1. As shown, when the x is between 0 and 3, the critical rod diameter is at least 2 mm, while when x is 1 the critical rod diameter is 3 mm. Differential calorimetry scans for sample metallic glasses in which P is substituted by equal amounts of Si and B are presented in FIG. 2. The Curie, glass-transition, crystallization, solidus, and liquidus temperatures $T_c$, $T_g$, $T_x$, $T_s$, and $T_l$ are designated in FIG. 2 and listed in Table 1. Interestingly, Example alloy 2, which has the highest glass forming ability among the alloys of Table 1, is also the closest to a eutectic composition as $T_s$ and $T_l$ are closer together than the rest of the alloys.

TABLE 1

Example alloys demonstrating the effect of increasing the Si and B atomic concentration at the expense of P on the glass forming ability of the Fe—Co—Si—B—P system.

| Example | Composition | Critical Rod Diameter (mm) | $T_c$(° C.) | $T_g$(° C.) | $T_x$(° C.) | $T_s$(° C.) | $T_l$(° C.) |
|---|---|---|---|---|---|---|---|
| 1 | $Fe_{60}Co_{17}Si_{6.5}B_{5.5}P_{11}$ | 2 | 439 | 491 | 521 | 970 | 1048 |
| 2 | $Fe_{60}Co_{17}Si_7B_6P_{10}$ | 3 | 441 | 495 | 527 | 983 | 1035 |
| 3 | $Fe_{60}Co_{17}Si_{7.5}B_{6.5}P_9$ | 2.5 | 445 | 502 | 527 | 972 | 1054 |
| 4 | $Fe_{60}Co_{17}Si_8B_7P_8$ | 2.5 | 465 | 509 | 534 | 988 | 1074 |

In other embodiments, ferromagnetic alloys that are substantially close to the peak in glass forming ability that have a critical rod diameter of at least 2 mm can be represented by the following Equation (subscripts denote atomic percent):

$$Fe_{(100-a-b-c-d-e)}Co_aSi_cB_dP_e \quad (2)$$

where a ranges from 5 to 40, c ranges from 5 to 8.5, and d ranges from 4 to 9, e ranges from 7 to 12. In some such embodiments the sum of c, d, and e is between 22 and 24.

Figure 3:
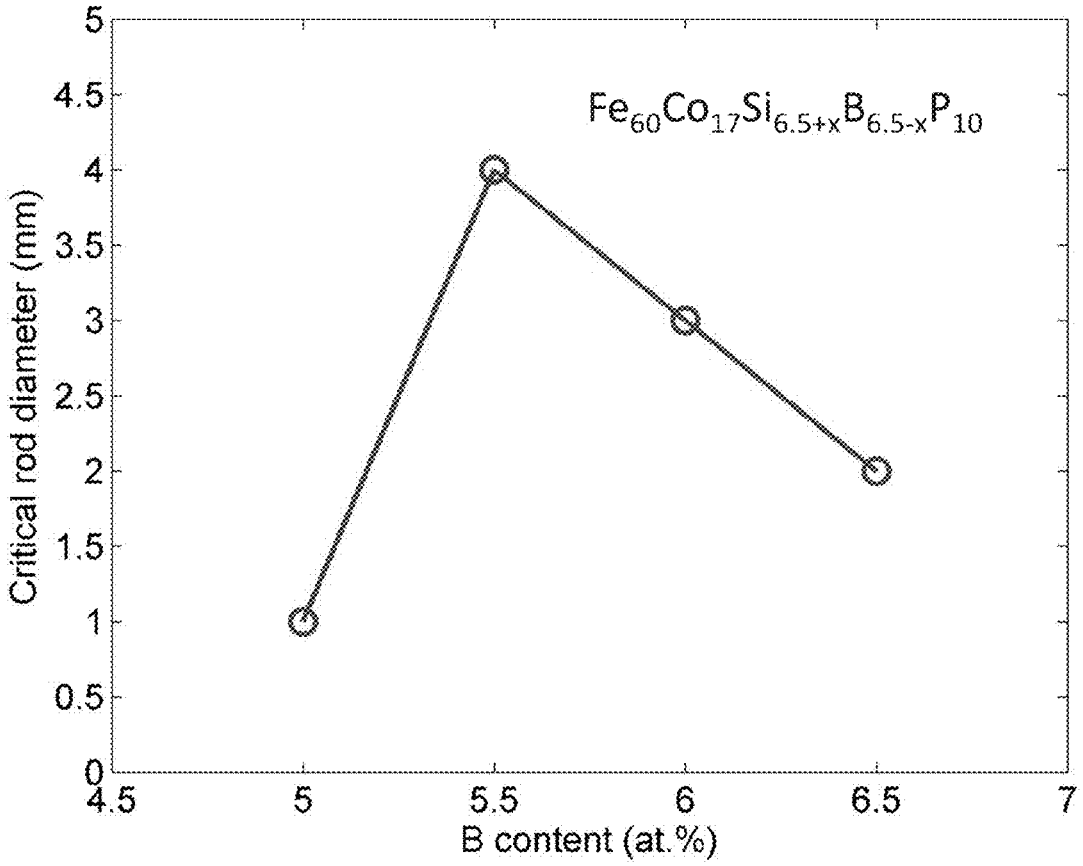
FIG. 3 provides a plot showing the effect of substituting B by Si according to the formula $Fe_{60}Co_{17}Si_{6.5+x}B_{6.5-x}P_{10}$ in accordance with embodiments of the invention.
Figure 4:
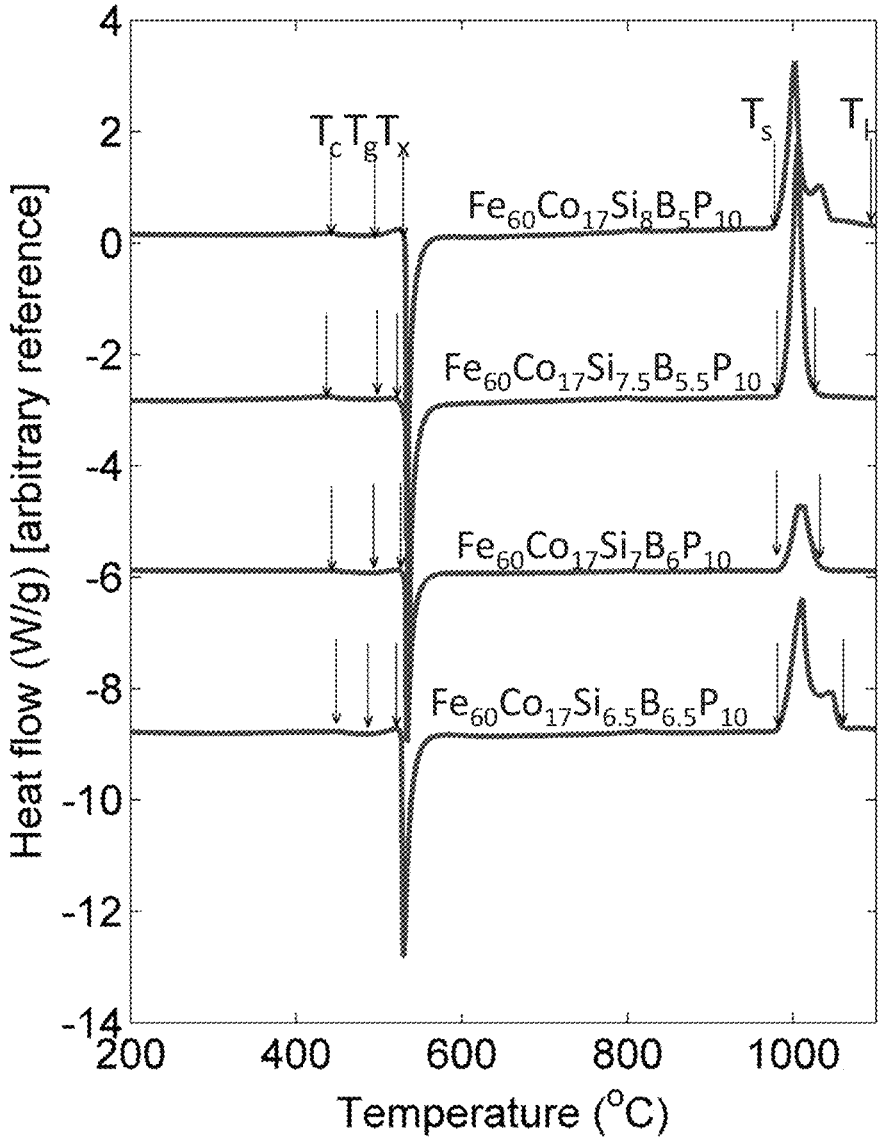
FIG. 4 provides a plot showing calorimetry scans for sample metallic glasses $Fe_{60}Co_{17}Si_{6.5+x}B_{6.5-x}P_{10}$ in accordance with embodiments of the invention. Arrows from left to right designate the Curie, glass-transition, crystallization, solidus, and liquidus temperatures, respectively.
Figure 5:
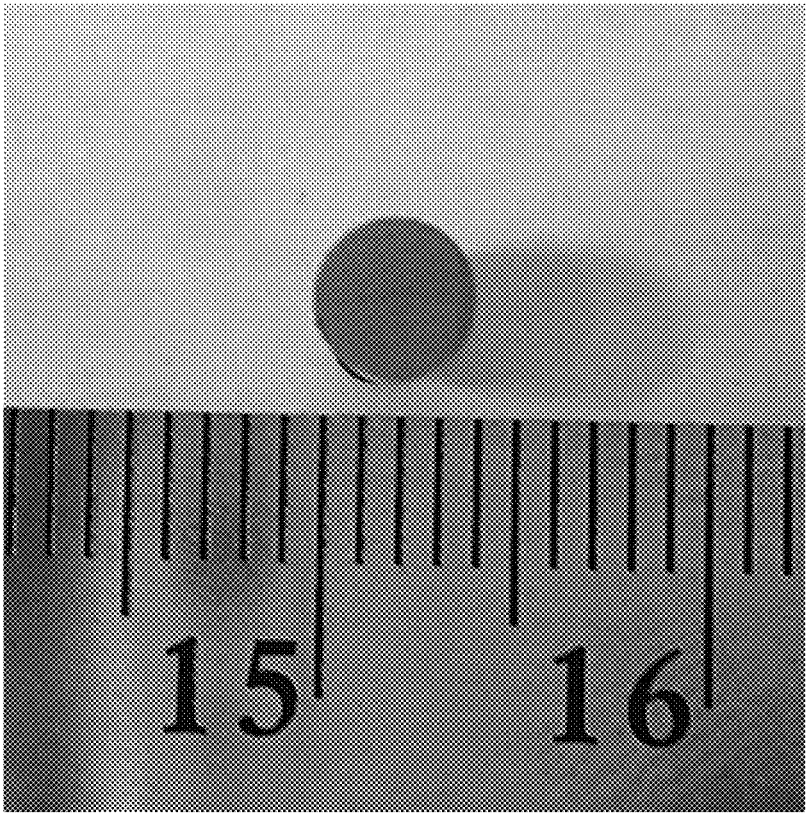
FIG. 5 provides an image of an amorphous 4 mm rod of exemplary alloy $Fe_{60}Co_{17}Si_{7.5}B_{5.5}P_{10}$ (Example 6).
Figure 6:
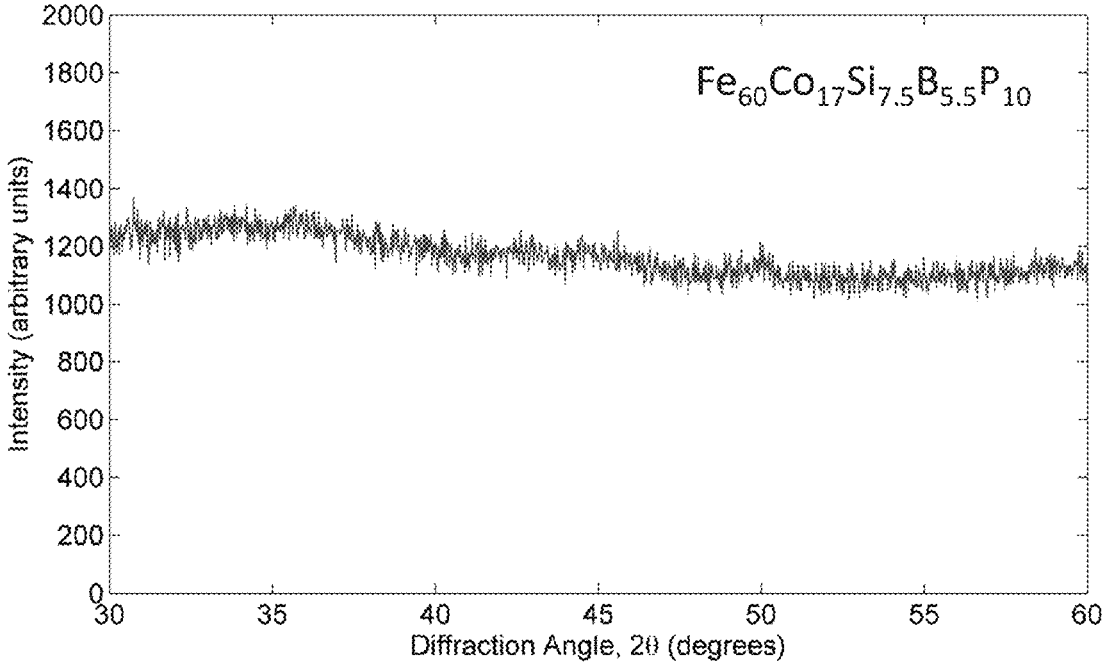
FIG. 6 provides an X-ray diffractogram verifying the amorphous structure of a 4 mm rod of exemplary alloy $Fe_{60}Co_{17}Si_{7.5}B_{5.5}P_{10}$ (Example 6).

In other embodiments, ferromagnetic alloys that are substantially close to the peak in glass forming ability that have a critical rod diameter of at least 2 mm can be represented by the following Equation (subscripts denote atomic percent):

Sample alloys (Examples 2 and 5-7) showing the effect of substituting B by Si according to the formula $Fe_{60}Co_{17}Si_{6.5+x}B_{6.5-x}P_{10}$, where x ranges between 0 and 3, are presented in Table 2 and FIG. 3. As shown, when the x is between 0 and 1.5, the critical rod diameter is at least 1 mm, while when x is 1 the critical rod diameter is 6 mm. Differential calorimetry scans for sample metallic glasses in which B is substituted by Si are presented in FIG. 4. The Curie, glass-transition, crystallization, solidus, and liquidus temperatures $T_c$, $T_g$, $T_x$, $T_s$, and $T_l$ are designated in FIG. 4 and listed in Table 2. Interestingly, Example alloy 6, which has the highest glass forming ability among the alloys of Table 2, is also the closest to a eutectic composition as $T_s$ and $T_l$ are closer together than the rest of the alloys. In fact as seen in the calorimetry scan of FIG. 4, Example alloy 6 appears to be fairly precisely at the eutectic composition, as both liquid crystallization and crystal melting processes evolve by a unique event characterized by a very sharp enthalpy change, which is indicative of a eutectic transition. Correspondingly, Example alloy 6 appears to be the best glass forming alloy among the disclosed alloys. FIG. 5 provides an image of an amorphous 4 mm rod of alloy $Fe_{60}Co_{17}Si_{7.5}B_{5.5}P_{10}$ (Example 6). FIG. 6 provides an X-ray diffractogram verifying the amorphous structure of a 4 mm rod of alloy $Fe_{60}Co_{17}Si_{7.5}B_{5.5}P_{10}$ (Example 6).

TABLE 2

Example alloys demonstrating the effect of increasing the Si atomic concentration at the expense of B on the glass forming ability of the Fe—Co—Si—B—P system.

| Example | Composition | Critical Rod Diameter (mm) | $T_c$(° C.) | $T_g$(° C.) | $T_x$(° C.) | $T_s$(° C.) | $T_l$(° C.) |
|---|---|---|---|---|---|---|---|
| 5 | $Fe_{60}Co_{17}Si_{6.5}B_{6.5}P_{10}$ | 2 | 448 | 490 | 523 | 980 | 1060 |
| 2 | $Fe_{60}Co_{17}Si_7B_6P_{10}$ | 3 | 441 | 495 | 527 | 983 | 1035 |
| 6 | $Fe_{60}Co_{17}Si_{7.5}B_{5.5}P_{10}$ | 4 | 437 | 499 | 523 | 982 | 1026 |
| 7 | $Fe_{60}Co_{17}Si_8B_5P_{10}$ | 1 | 441 | 495 | 528 | 977 | 1095 |

Figure 7:
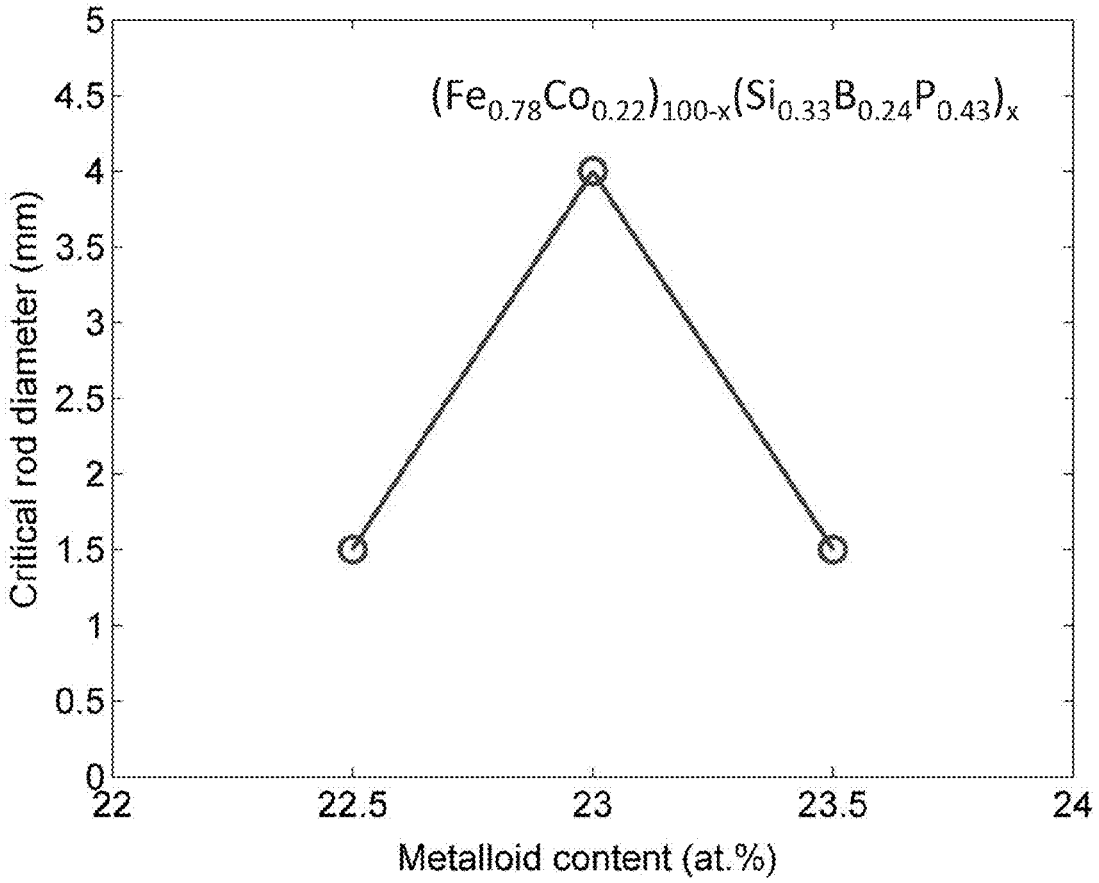
FIG. 7 provides a plot showing the effect of varying the metals to metalloids ratio according to the formula $(Fe_{0.78}Co_{0.22})_{100-x}(Si_{0.33}B_{0.24}P_{0.43})_x$ in accordance with embodiments of the invention.
Figure 8:
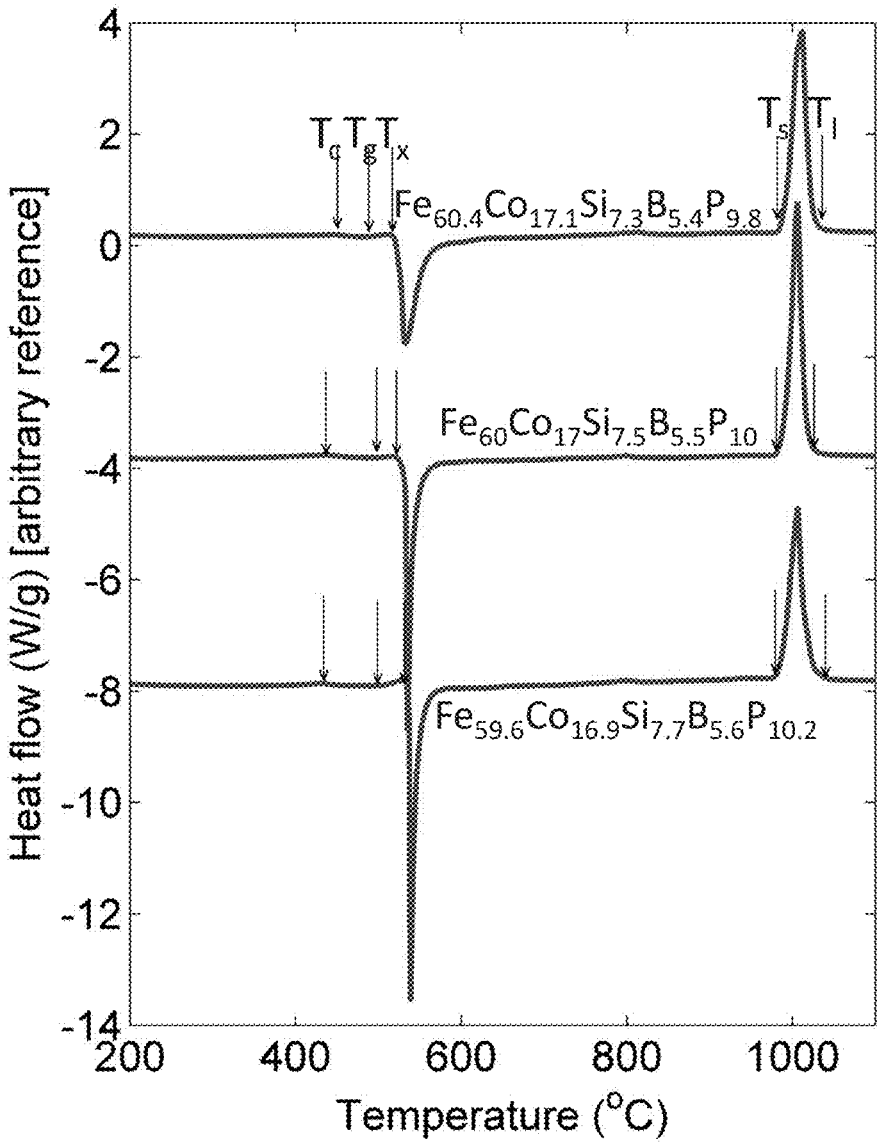
FIG. 8 provides a plot showing calorimetry scans for sample metallic glasses $(Fe_{0.78}Co_{0.22})_{100-x}(Si_{0.33}B_{0.24}P_{0.43})_x$ in accordance with embodiments of the invention. Arrows from left to right designate the Curie, glass-transition, crystallization, solidus, and liquidus temperatures, respectively.

Sample alloys (Examples 6, 8, and 9) showing the effect of varying the metals to metalloids ration according to the formula $(Fe_{0.78}Co_{0.22})_{100-x}(Si_{0.33}B_{0.24}P_{0.43})_x$, where x ranges between 22.5 and 23.5, are presented in Table 3 and FIG. 7. As shown, when the x is between 22.5 and 23.5, the critical rod diameter is at least 1.5 mm, while when x is 23 the critical rod diameter is 4 mm. Differential calorimetry scans for sample metallic glasses in which the metal to metalloid ratio is varied are presented in FIG. 8. The Curie, glass-transition, crystallization, solidus, and liquidus temperatures $T_c$, $T_g$, $T_x$, $T_s$ and $T_l$ are designated in FIG. 8 and listed in Table 3. Example alloys 8 and 9, which have significantly lower glass forming ability than Example alloy 6, are also further from the eutectic composition than Example alloy 6, which is fairly precisely at the eutectic composition.

TABLE 3

Example alloys demonstrating the effect of increasing the metalloid concentration at the expense of metals on the glass forming ability of the Fe—Co—Si—B—P system.

| Example | Composition | Critical Rod Diameter (mm) | $T_c$(° C.) | $T_g$(° C.) | $T_x$(° C.) | $T_s$(° C.) | $T_l$(° C.) |
|---|---|---|---|---|---|---|---|
| 8 | $Fe_{60.4}Co_{17.1}Si_{7.3}B_{5.4}P_{9.8}$ | 1.5 | 449 | 490 | 516 | 981 | 1036 |
| 6 | $Fe_{60}Co_{17}Si_{7.5}B_{5.5}P_{10}$ | 4 | 437 | 499 | 523 | 982 | 1026 |
| 9 | $Fe_{59.6}Co_{16.9}Si_{7.7}B_{5.6}P_{10.2}$ | 1.5 | 433 | 499 | 533 | 981 | 1041 |

Other exemplary Fe—Co—Si—B—P and Fe—Co—Ni—Si—B—P alloys in accordance to the current disclosure are listed in Table 4 along with the associated critical rod diameters.

TABLE 4

Example Fe—Co—Si—B—P and Fe—Co—Ni—Si—B—P alloys.

| Example | Composition | Critical Rod Diameter [mm] |
|---|---|---|
| 17 | $Fe_{55}Co_{22}Si_{8.5}B_{7.5}P_7$ | 1 |
| 18 | $Fe_{50}Co_{27}Si_{8.5}B_{7.5}P_7$ | 1 |
| 19 | $Fe_{60}Co_{17}Si_8B_{7.5}P_{7.5}$ | 2.5 |
| 20 | $Fe_{60}Co_{17}Si_{8.5}B_7P_{7.5}$ | 2.5 |

TABLE 4-continued

Example Fe—Co—Si—B—P and Fe—Co—Ni—Si—B—P alloys.

| Example | Composition | Critical Rod Diameter [mm] |
|---|---|---|
| 21 | $Fe_{60}Co_{17}Si_8B_6P_9$ | 2 |
| 22 | $Fe_{60}Co_{17}Si_{7.5}B_{6.5}P_9$ | 2 |
| 23 | $Fe_{60}Co_{17}Si_7B_7P_9$ | 2 |
| 24 | $Fe_{60}Co_{17}Si_{6.5}B_{7.5}P_9$ | 2 |

TABLE 4-continued

Example Fe—Co—Si—B—P and Fe—Co—Ni—Si—B—P alloys.

| Example | Composition | Critical Rod Diameter [mm] |
|---|---|---|
| 26 | $Fe_{60}Co_{17}Si_{8.5}B_{7.5}P_7$ | 1 |
| 26 | $Fe_{60}Co_{15}Ni_2Si_{7.5}B_{5.5}P_{10}$ | 1.5 |

Description of Methods of Processing the Sample Alloys

A method for producing the alloys involves inductive melting of the appropriate amounts of elemental constituents in a quartz tube under inert atmosphere. The purity levels of the constituent elements were as follows: Fe 99.95%, Co 99.95%, Ni 99.995%, Si 99.9999%, B 99.5%, and P 99.9999%. The melting crucible may alternatively be a ceramic such as alumina or zirconia, graphite, sintered crystalline silica, or a water-cooled hearth made of copper or silver.

Prior to producing an amorphous article, the alloyed ingots may be fluxed with a reducing agent such as boron oxide. A method for fluxing the alloy ingots involves remelting the ingots in a quartz tube under inert atmosphere, bringing the alloy melt in contact with molten boron oxide and allowing the two melts to interact for about a time period of 1000 seconds at a temperature of about 1100° C. or higher, and subsequently water quenching. A method for producing glassy rods from the alloy ingots involves remelting the ingots in quartz tubes of 0.5-mm thick walls in a furnace at 1100° C. or higher, and particularly between 1200° C. and 1400° C., under high purity argon and rapidly quenching in a room-temperature water bath. In general, amorphous articles from the alloy of the present disclosure can be produced by either (1) re-melting the alloy ingots in quartz tubes having 0.5-mm thick walls, holding the melt at a temperature of about 1100° C. or higher, and particularly between 1200° C. and 1400° C., under inert atmosphere, and rapidly quenching in a liquid bath; or (2) re-melting the alloy ingots, holding the melt at a temperature of about 1100° C. or higher, and particularly between 1200° C. and 1400° C., under inert atmosphere, and injecting or pouring the molten alloy into a metal mold, particularly made of copper, brass, or steel.

Test Methodology for Assessing Glass-Forming Ability

The glass-forming ability of each alloy was assessed by determining the maximum rod diameter in which the amorphous phase of the alloy (i.e. the metallic glass phase) could be formed when processed by the method described above. X-ray diffraction with Cu—Kα radiation was performed to verify the amorphous structure of the alloys.

Test Methodology for Differential Scanning Calorimetry

Differential scanning calorimetry was performed on sample metallic glasses at a scan rate of 20 K/min to determine the Curie, glass-transition, crystallization, solidus, and liquidus temperatures of sample metallic glasses.

The disclosed Fe—Co—Si—B—P alloys with controlled ranges along the composition ridge demonstrate good glass forming ability. The disclosed alloys are capable of forming metallic glass rods of diameters at least 1 mm and up to about 4 mm or greater when processed by the particular method described herein. The combination of high glass-forming ability along with excellent ferromagnetic properties makes the present Fe-based metallic glasses excellent candidates for various magnetic applications. Among many other applications, the disclosed alloys may be used in consumer electronics, dental and medical implants and instruments, luxury goods, and sporting goods applications.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween

What is claimed is:

1. An Fe-bearing alloy, consisting of Co with an atomic fraction denoted by a, Ni with an atomic fraction denoted by b, Si with an atomic fraction denoted by c, B with an atomic fraction denoted by d, P with an atomic fraction denoted by d;

where a is between 2 and 60, b is up to 10, c ranges from 4 to less than 9, d ranges from 3 to less than 10, e ranges from more than 5 to 15, and where the balance is Fe and incidental impurities; and wherein the critical rod diameter of the Fe-bearing alloy is at least 1 mm.

2. The alloy of claim 1, wherein a is between 5 and 40, b is 0, c is between 5 and 8.5, d is between 4 and 9, e is between 6 and 13, and wherein the critical rod diameter is at least 2 mm.

3. The alloy of claim 1, wherein a is between 10 and 30, b is 0, c is between 6 and 8.5, d is between 5 and 8, e is between 7 and 12, and wherein the critical rod diameter is at least 2.5 mm.

4. The alloy of claim 1, wherein a is between 12 and 25, b is 0, c is between 6.5 and 8, d is between 5.5 and 7.5, e is between 8 and 11, and wherein the critical rod diameter is at least 3 mm.

5. The alloy of claim 1, wherein the sum of c, d, and e is between 21 and 25.

6. The alloy of claim 1, wherein a is between 5 and 40, b is 0, the sum of c, d, and e is between 22 and 24, and wherein the critical rod diameter is at least 2 mm.

7. The alloy of claim 1, wherein a is between 10 and 30, b is 0, the sum of c, d, and e is between 22.5 and 23.5, and wherein the critical rod diameter is at least 2.5 mm.

8. The alloy of claim 1, wherein the ratio of the atomic fraction of Co to the atomic fraction Fe is between 0.2 and 0.4.

9. The alloy of claim 1, wherein the solidus and liquidus temperatures of the alloy are within 100° C. apart when evaluated by a calorimetry scan rate of 20 K/min, and wherein the critical rod diameter is at least 1 mm.

10. The alloy of claim 1, wherein the solidus and liquidus temperatures of the alloy are within 80° C. apart when evaluated by a calorimetry scan rate of 20 K/min, and wherein the critical rod diameter is at least 2 mm.

11. The alloy of claim 1, wherein the solidus and liquidus temperatures of the alloy are within 60° C. apart when evaluated by a calorimetry scan rate of 20 K/min, and wherein the critical rod diameter is at least 2.5 mm.

12. The alloy of claim 1, wherein the solidus and liquidus temperatures of the alloy are within 50° C. apart when evaluated by a calorimetry scan rate of 20 K/min, and wherein the critical rod diameter is at least 3 mm.

13. The alloy of claim 1, wherein the incidental impurities may contain up to 2 atomic percent of any element selected from the group consisting of Mo, Cr, Nb, Ge, and C.

14. A metallic glass comprising the alloy of claim 1.

15. A method for processing an Fe-bearing alloy to form a metallic glass, the method comprising:

melting an Fe-bearing alloy consisting of, Co with an atomic fraction denoted by a, Ni with an atomic fraction denoted by b, Si with an atomic fraction denoted by c, B with an atomic fraction denoted by d, P with an atomic fraction denoted by d;

where a is between 2 and 60, b is up to 10, c ranges from 4 to less than 9, d ranges from 3 to less than 10, e ranges from more than 5 to 15, and where the balance is Fe and incidental impurities;

wherein the critical rod diameter of the Fe-bearing alloy is at least 1 mm; and quenching the molten alloy at a cooling rate sufficiently rapid to prevent crystallization of the alloy to form the metallic glass.

16. The method of claim 15, wherein the melt is fluxed with a reducing agent prior to quenching.

17. The method of claim 16, wherein the reducing agent is boron oxide.

18. The method of claim 16, wherein the temperature during fluxing is at least 200 degrees above the liquidus temperature of the alloy.

19. The method of claim 15, wherein the melt temperature prior to quenching to form the amorphous sample is at least 200 degrees above the liquidus temperature of the alloy.

20. The method of claim 15, wherein the melt temperature prior to quenching to form the amorphous sample is at least 1300° C.

* * * * *